US007079100B2

(12) United States Patent
Miyajima et al.

(10) Patent No.: US 7,079,100 B2
(45) Date of Patent: Jul. 18, 2006

(54) ACTIVE MATRIX TYPE DISPLAY

(75) Inventors: Yasushi Miyajima, Gifu (JP); Ryoichi Yokoyama, Ogaki (JP)

(73) Assignee: Sanyo Electric Co., Ltd. (JP)

( * ) Notice: Subject to any disclaimer, the term of this patent is extended or adjusted under 35 U.S.C. 154(b) by 411 days.

(21) Appl. No.: 10/441,539

(22) Filed: May 19, 2003

(65) Prior Publication Data

US 2004/0119704 A1 Jun. 24, 2004

Related U.S. Application Data

(60) Provisional application No. 60/435,826, filed on Dec. 20, 2002.

(51) Int. Cl.
*G09G 3/36* (2006.01)

(52) U.S. Cl. ..... 345/90; 345/96

(58) Field of Classification Search ..... 345/87, 345/90, 93, 96, 100; 349/37, 38, 39
See application file for complete search history.

(56) References Cited

U.S. PATENT DOCUMENTS 6,239,779 B1 * 5/2001 Furuya et al. ..... 345/87
6,433,767 B1 * 8/2002 Murade ..... 345/92
6,590,552 B1 7/2003 Yokoyama et al.

FOREIGN PATENT DOCUMENTS

JP 2000081616 3/2000
JP 2003150127 5/2003

OTHER PUBLICATIONS

Copy of Office Action for the corresponding Korean Patent Applicatin, No. 10-2002-0086670 with English excerpt translation.
Copy of Japanese Patent Laid-Open Publication, No. 2002-98997 with English abstract, and English excerpt translation.

* cited by examiner

*Primary Examiner*—Dennis-Doon Chow
(74) *Attorney, Agent, or Firm*—Cantor Colburn LLP

(57) ABSTRACT

An active matrix type display includes supplementary capacity electrodes arranged at every pixel region in which a pixel electrode is formed, and supplementary capacities composed of a first and a second supplementary capacity lines arranged correspondingly to a plurality of the pixel electrodes. The display performs display by applying either of a first video signal voltage having a polarity inverting at every frame period or a second video signal voltage having a polarity inverse to that of the first video signal voltage to the pixel electrodes through switching elements. Thereby, so-called dot inversion driving can be realized through the supplementary capacity lines.

14 Claims, 7 Drawing Sheets

ACTIVE MATRIX TYPE DISPLAY

CROSS-REFERENCE TO RELATED APPLICATIONS

The present application claims the benefit of the date of the earlier filed provisional application, having U.S. Provisional Application No. 60/435,826, filed on Dec. 20, 2002, which is incorporated herein in its entirety.

BACKGROUND OF THE INVENTION

1. Field of the Invention

The present invention relates to an active matrix type display.

2. Description of the Related Art

An active matrix type display supplies respective image signals to separated pixel electrodes through switching elements such as thin film transistors (TFTs). Deterioration of the liquid crystal of such an active matrix type display is commonly prevented by driving the display using an alternating current (AC) driving configuration in which alternating potential is applied to an opposite electrode and supplementary capacities of the display. Meanwhile, electric power consumption of the display is often conserved by decreasing an electric potential difference between the positive polarity and the negative polarity of a video signal to be input into the drain driver of the display, and by decreasing the current and voltage of the drain driver.

There is also known a method referred to as horizontal inversion opposite AC driving in which the polarities of a video signal to be supplied to each drain line are inverted at every horizontal period. However, because in the horizontal inversion opposite AC driving the polarities of the voltages of the opposite electrode and all of the supplementary capacity lines are inverted every horizontal period, capacitive loads in the opposite electrode and in all of the supplementary capacity lines remain large, the electrical power consumption also remains great.

To attempt to further decrease the electrical power consumption, a further driving method, hereinafter referred to as "SC driving", is known. In SC driving, the electrical power consumption can be remarkably decreased by inverting the polarities of the voltages of the supplementary capacities and by setting the voltage of the opposite electrode to be a fixed voltage. SC driving also decreases the current and the voltage of the drain driver by decreasing the potential difference between the positive polarity and the negative polarity of a video signal. In the following, an active matrix type liquid crystal display employing SC driving will be described.

FIG. 11 is an equivalent circuit diagram of a display panel of an active matrix type liquid crystal display employing SC driving. A plurality of drain lines 105 are arranged along vertical directions, and a plurality of gate lines 107 are arranged along horizontal directions. At the intersections of the drain lines 105 and the gate lines 107, TFTs 109 being switching elements are provided.

The gates of the TFTs 109 are connected to the gate lines 107, and the drains of the TFTs 109 are connected to the drain lines 105. The sources of the TFTs 109 are connected to electrodes on one side of liquid crystal capacities 112. The remaining electrodes, those on the other side of the liquid crystal capacities 112, constitute an opposite electrode 111, which is integrally formed with a substrate arranged on the opposite side of another substrate, on which the TFTs 109 are formed, with liquid crystal sandwiched the substrates.

Moreover, capacity electrodes on one side of supplementary capacities 110 are connected to the sources of the TFTs 109. The electrodes on the other side of the supplementary capacities 110 are connected to supplementary capacity lines 108. The supplementary capacity lines 108 are formed in parallel with the gate lines 107, and are commonly connected to a plurality of the supplementary capacities 110 aligned in row directions.

FIG. 12 shows signal waveforms for driving one pixel in a display panel. FIG. 12 shows a gate voltage $V_G$, a pixel voltage $V_P$, a source voltage $V_S$, a video signal voltage $V_D$, a supplementary capacity voltage $V_{SC}$ and an opposite electrode voltage $V_{COM}$. The gate voltage $V_G$ has one period each frame.

In an on period of gates, the gate voltage $V_G$ to be applied to a gate line 107 takes a high (hereinafter referred to as "High") level. During this period, TFTs 109 connected to the gate line 107 are turned on, and the drains of the TFTs 109 conduct to the gates of the TFTs 109. The source voltages Vs then follow the video signal voltages $V_D$, which are applied to the drain lines 105, to assume levels equal to those of the video signal voltages $V_D$. Then, the source voltages $V_S$ are applied to the capacity electrodes on one side of the liquid crystal capacities 112 and the supplementary capacities 110 which are arranged at the row of the selected gate line 107. When the operation enters into a gate off period, the gate voltage $V_G$ becomes a low (hereinafter referred to as "Low") level, and the TFTs 109 are turned off. Then, the source voltages $V_S$ are determined, and descend in level by a voltage $.V_S$ accompanying the falling of the gate voltage $V_G$ to be a voltage $V_{PL}$.

The opposite electrode voltage $V_{COM}$ is a fixed voltage. The level of the opposite electrode voltage $V_{COM}$ is lowered from the center levels $V_C$ of the video signal voltages $V_D$ by the amount of the descended voltage $.V_S$ of the source voltages $V_S$.

The supplementary capacity voltages $V_{SC}$ are applied to each supplementary capacity line 108. The levels of the supplementary capacity voltages $V_{SC}$ are inverted after the gate voltage $V_G$ applied to a corresponding gate line 107 falls. The supplementary capacity voltages $V_{SC}$ are severally inverted between two levels of a high level $V_{SCH}$ and a low level $V_{SCL}$. For example, in a positive polarity period, in which the source voltages $V_S$ are higher than the opposite electrode voltage $V_{COM}$, the supplementary capacity voltages $V_{SC}$ rise from their low levels $V_{SCL}$ to their high levels $V_{SCH}$ after the falling of the gate voltage $V_G$. Consequently, the pixel voltages $V_P$ are obtained by the temporary determination of the source voltages $V_S$ after the falling of the gate voltage $V_G$. After that, the obtained pixel voltages $V_P$ severally ascend by a voltage $.V_P$ owing to an influence of the rising of the supplementary capacitor voltages $V_{SC}$ through the supplementary capacities 110. The pixel voltages $V_P$ at this time are held during the off period of the gates, i.e. within the frame period.

As described above, because of the rises in the supplementary capacity voltages $V_{SC}$, charges are reallocated between the liquid crystal capacities 112 and the supplementary capacities 110. Then, the pixel voltages $V_P$ ascend by the voltage $.V_P=V_{PH}-V_{PL}$. In a negative polarity period, in which the source voltages $V_S$ are lower than the opposite electrode voltage $V_{COM}$, the supplementary capacity voltages $V_{SC}$ inversely fall from their positive sides to their negative sides. Consequently, the pixel voltages $V_P$ severally descend by the voltage $.V_P$. As a result, the amplitudes of the pixel voltages $V_P$ become larger, which makes it possible to enlarge the voltage to be applied to the liquid crystal 112.

That is, by inverting the supplementary capacity voltages $V_{SC}$ between the two levels severally, it becomes possible to make the amplitudes of the video signal voltages $V_D$ small for applying sufficient voltages to the liquid crystal capacities 112 even if the opposite electrode voltage $V_{COM}$ is a direct-current voltage.

Because the supplementary capacities 110 are ordinarily sufficiently larger than the liquid crystal capacities 112, the amounts of changed voltages .$V_P$ of the pixel voltages $V_P$ are controlled in response to the variation voltages V ($V_{SCH}$–$V_{SCL}$) of the supplementary capacity voltages $V_{SC}$ for each line. Accordingly, by varying the supplementary capacity voltages $V_{SC}$ of the supplementary capacity lines 108, large voltages can be applied to the liquid capacities 112. In other words, by varying the supplementary capacity voltages $V_{SC}$, it is possible to make the amplitudes of the video signal voltages $V_D$ small.

As the number of pixels in typical displays has increased, additional methods have been employed to deal with the increase. On such method involves simultaneously switching on a plurality of drain lines, and then applying the video signal voltages $V_D$ to a plurality of the liquid crystal capacities 112 and the supplementary capacities 110 simultaneously. Thereby, it becomes possible to secure sufficient time for the drain lines 105 to apply the video signal voltages $V_D$ to the liquid crystal capacities 112 and the supplementary capacities 110.

In particular, when a display panel large in size or highly fine in display quality is dot-sequentially driven, several tens of the drain lines 105 are turned on at the same time, and the video signals $V_D$ are applied to several tens of the liquid crystal capacities 112 and the supplementary capacities 110 at the same time. When several tens of the drain lines 105 are simultaneously turned on in this manner, a large capacity coupling is generated at parts where the ON drain lines 105 are superposed on the supplementary capacity lines 108. The voltages of the supplementary capacity lines 108 and the gate lines 107 are influenced by the voltages of the drain lines 105 through the capacity coupling. Because of the voltage changes, nonuniformity of an image is sometimes generated for every group of drain lines 105 which are turned on at the same time.

SUMMARY OF THE INVENTION

With the present invention it is possible to apply voltages different in polarities to every unit of adjoining single or plural pixel electrodes. That is, the present invention enables so-called "dot inversion".

An active matrix type display according to the present invention comprises first and second supplementary capacity lines extending in row directions corresponding to each row of pixel electrodes, and supplementary capacities arranged alternatively at every row of the pixel electrodes corresponding to the first and the second supplementary capacity lines. Thereby, signals having different polarities can be supplied to each supplementary capacity line. Consequently, it becomes possible to realize dot inversion driving for applying voltages different in polarities at every adjoining pixel through the first and the second supplementary capacity lines.

With the present invention, it is also preferable to supply to the first and the second supplementary capacity lines a first and a second supplementary capacity voltages opposite in phase the voltages changing during off periods of switching elements. Thereby, the dot inversion driving through the supplementary capacity lines can be realized. If is also possible to apply sufficient voltages to pixel electrodes while the amplitudes of video signal voltages are made sufficiently small.

DESCRIPTION OF PREFERRED EMBODIMENTS

Figure 1:
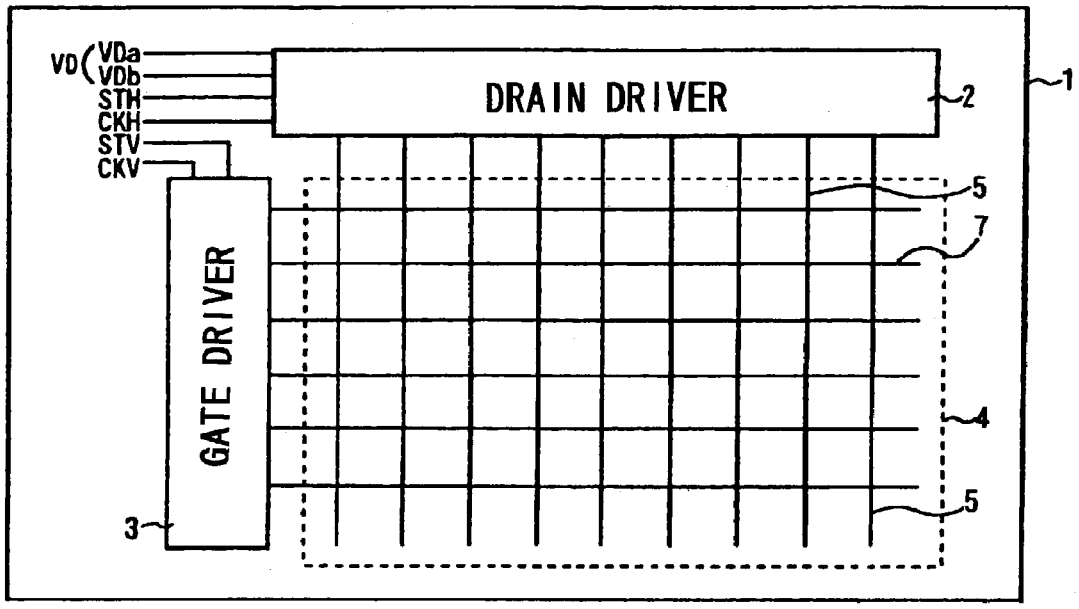
FIG. 1 is a plan view of a display panel of an active matrix type display.
Figure 2:
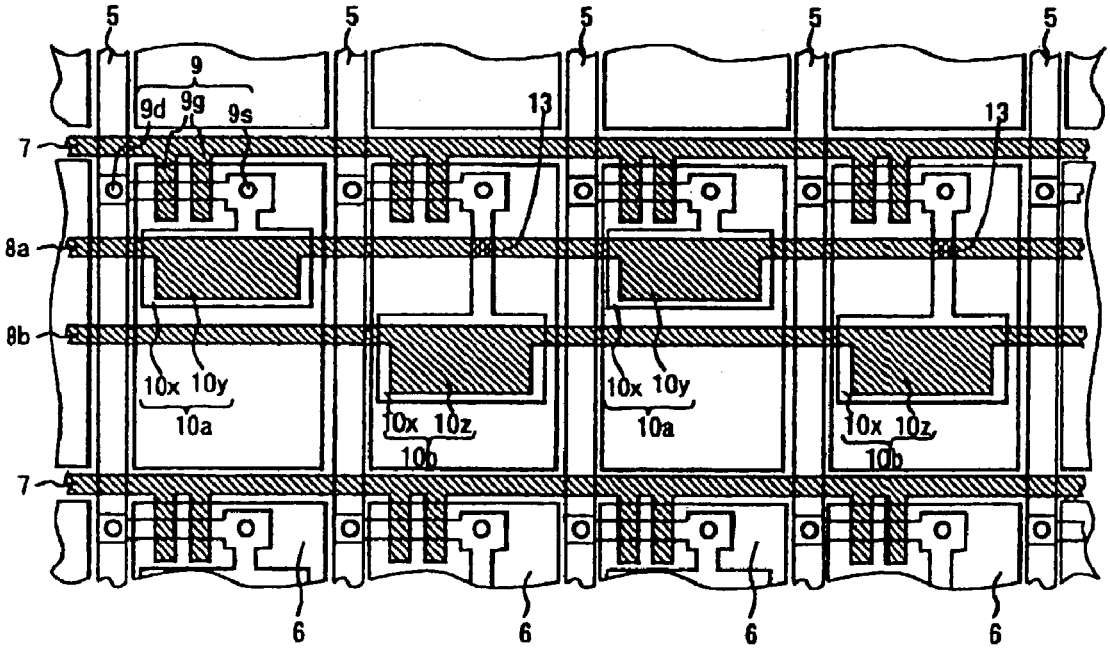
FIG. 2 is a plan view of a display panel according to a first embodiment of the present invention.

A first preferred embodiment of the present invention will be described. FIG. 1 is a plan view of a display panel in an active matrix type display. FIG. 2 is a plan view of a display panel according to the first embodiment, and FIG. 3 is an equivalent circuit diagram of the display panel.

As shown in FIG. 1, in the display panel 1, a drain driver is arranged as a row driver in a row direction, and a gate driver 3 is arranged as a column driver in a column direction. Then, a display region 4 for displaying images is arranged to be enclosed by the drain driver 2 and the gate driver 3.

Figure 3:
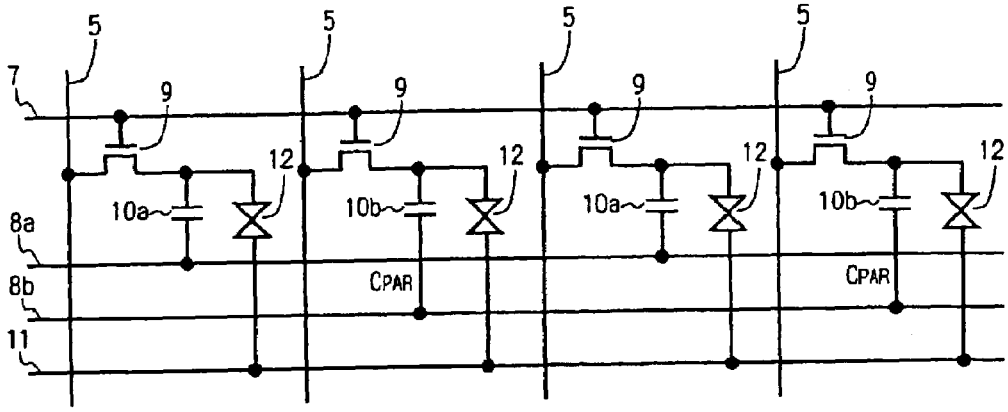
FIG. 3 is an equivalent circuit diagram of the display panel according to the first embodiment of the present invention.

As shown in FIGS. 2 and 3, in the display region 4, a plurality of drain lines 5 as data lines and a plurality of pixel electrodes 6 shaped in a rectangle elongated in a column direction are arranged along row directions. Also in the display region 4, a plurality of gate lines 7 as selection lines, a plurality of first supplementary capacity lines 8*a* and a plurality of second supplementary capacity lines 8*b* are arranged along row directions. In a region in which each pixel electrode 6 is arranged (hereinafter referred to as "pixel region"), a TFT 9 and either of a first supplementary capacity 10*a* and a second supplementary capacity 10*b* are arranged.

The TFT 9 is composed of gate electrodes 9*g* formed in a shape elongating from a gate line 7, a channel region of a semiconductor layer arranged under the gate electrodes 9*g*, a drain region 9*d* of a semiconductor layer connected to a drain line 5 electrically through a contact, and a source region 9*s* of a semiconductor layer connected to the pixel electrode 6 electrically through a contact. In this example, the TFT 9 is a double gate type comprising two gate electrodes 9*g*.

The first supplementary capacity 10*a* is composed of a supplementary capacity electrode 10*x* of a semiconductor layer connected to the TFT 9, and a supplementary capacity electrode 10*y* formed in a shape elongating from a first supplementary capacity line 8*a*. The second supplementary capacity 10*b* is composed of a supplementary capacity electrode 10*x* and a supplementary capacity electrode 10*z* formed in a shape elongating from a second supplementary capacity line 8*b*.

Moreover, an opposite electrode 11 is formed on a substrate arranged on the side of the substrate opposite to that on which the TFTs 9 are formed, and liquid crystal is provided between the substrates. The opposite electrode 11 constitutes an opposite side capacity electrode corresponding to the pixel electrodes 6 of liquid crystal capacities 12.

Because n-channel TFTs are used as the TFTs 9 in the present embodiment, their data lines are referred to as drain lines, and the driver of the data lines is referred to as the drain driver. The TFTs 9 may also be composed of p-channel TFTs.

A first video signal voltage VDa and a second video signal voltage VDb having inverse polarities, are input to the drain driver 2 as shown in FIG. 1. The drain driver 2 selects the drain lines 5 in order, and applies either of the first vide signal voltage VDa and the second video signal voltage VDb to the selected drain line 5.

The gate driver 3 selects the gate lines 7 in order, and applies a gate signal GV to the selected gate line 7. In the display region 4, a plurality of the pixel electrodes 6 is arranged in a matrix. The display region 4 is a region in which images are displayed by applying voltages between the arranged pixel electrodes 6 and the opposite electrode 11.

Either of the first video signal voltage VDa and the second video signal voltage VDb is applied to each of the drain lines 5. The drain lines 5 are wiring for transmitting the applied video signal voltage VDa or VDb severally to the drains of the TFTs 9 through the contacts.

The pixel electrodes 6 constitute image regions, which are display units. The pixel electrodes 6 are electrodes for driving the liquid crystal together with the opposite electrode 11 by video signal voltages VD transmitted from the drain lines 5 through the TFTs 9.

The gate lines 7 are selected by the gate driver 3 to receive the gate signals GV. Thereby, the gate signal GV applied to the selected gate line 7 turns on the TFT 9 connected to the gate line 7.

The first supplementary capacity lines 8*a* are formed in the same layer of the gate lines 7, and are arranged to be parallel to the gate lines 7. A plurality of the supplementary capacity electrodes 10*y* aligned in row directions are integrally formed with the first supplementary capacity lines 8*a*. Consequently, the first supplementary capacity lines 8*a* connect the supplementary capacity electrodes 10*y* of the first supplementary capacities 10*a* of each row to each other.

The second supplementary capacity lines 8*b* are formed in the same layer as the gate lines 7, and are similarly arranged to be parallel to the gate lines 7. A plurality of the supplementary capacity electrodes 10*z* aligned in row directions are integrally formed with the second supplementary capacity lines 8*b*. Consequently, the second supplementary capacity lines 8*b* connect the supplementary capacity electrodes 10*z* of the second supplementary capacities 10*b* of each row to each other.

A first supplementary capacity voltage is supplied to the first capacity lines 8*a*, and a second supplementary capacity voltage having a polarity inverse to that of the first supplementary capacity voltage is supplied to the second supplementary capacity lines 8*b*.

The TFTs 9 are switching elements, in which, only when voltages are applied to the gate electrodes 9*s*, current flows in the channel regions of semiconductor layers formed under the gate electrodes 9*g* in either the direction from the source regions 9*s* to the drain regions 9*d* or the direction from the drain regions 9*d* to the source regions 9*s*. The first supplementary capacities 10*a* and the second supplementary capacities 10*b* hold charges of the video signal voltages VD supplied from the drain lines 5 through the TFTs 9 for a frame period to supplement the loss of the charges of the liquid crystal capacities 12.

A fixed voltage is applied to the opposite electrode 11. Consequently, driving voltages corresponding to the video signal voltages VD applied to the pixel electrodes 6 are applied to the liquid crystal between the pixel electrodes 6 and the opposite electrode 11, and then the liquid crystal capacities 12 at the pixels where the driving voltages are applied are driven.

The liquid crystal capacities 12 hold the charges which are held by the liquid crystal. These charges, which result from the video signal voltages VD supplied from the drain lines 5 through the TFTs 9, are very small in comparison with the charges held by the first supplementary capacities 10*a* or the second supplementary capacities 10*b*. Consequently, the charges held by the liquid crystal capacities 12 are easily discharged through leakage at off periods of the TFTs 9 or through impurities in the liquid crystal. Accordingly, the charges held by the liquid crystal capacities 12 are supplemented by the charges held by the first supplementary capacities 10*a* and the second supplementary capacities 10*b*.

Figure 4:
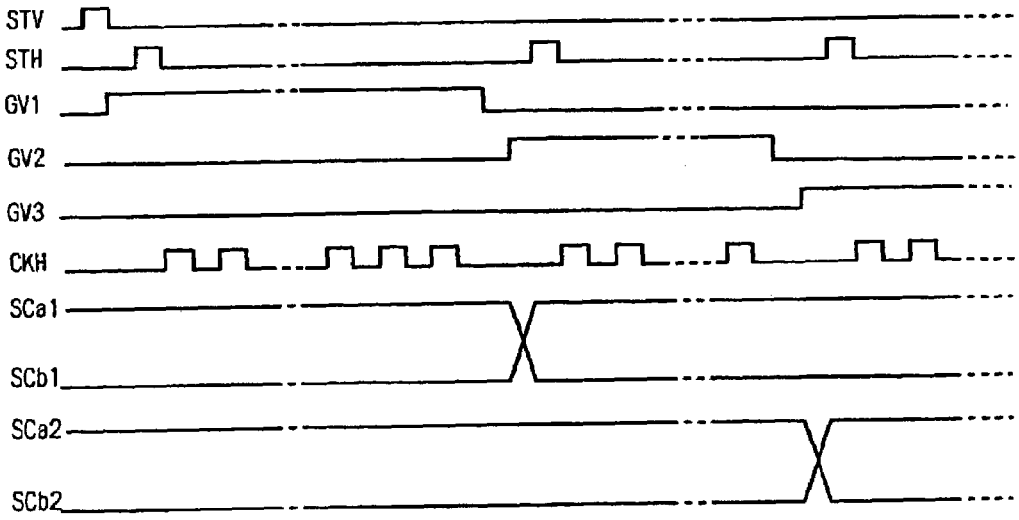
FIG. 4 is a timing chart showing relationships among respective signals in the display panel according to the first embodiment of the present invention.

Next, the driving method of the display panel 1 will be described. FIG. 4 is a timing chart showing relationships among each signal in the display panel 1. FIG. 4 shows the timing of voltage changes of a vertical start signal STV and gate signals GV1, GV2 and GV3, a horizontal start signal STH and a horizontal clock signal CKH, and the electric potential SCa of the first supplementary capacity lines 8*a* and the electric potential SCb of the second supplementary capacity lines 8*b*.

First, a pulse of the gate signal GV1 rises in response to a fall of a pulse of the vertical start signal STV, and then the gate signal GV1 is supplied to the gate line 7 at the first row. Thereby, the TFTs 9 connected to the gate line 7 at the first row are turned on. After that, a pulse of the horizontal start signal STH rises, and a first pulse of the horizontal clock signal CKH during the period in which the gate line 7 at the first row is being selected rises synchronously with the fall of the pulse of the horizontal start signal STH.

During the period in which the gate signal GV1 is being supplied to the gate line 7 at the first row, pulses of the horizontal clock signal CKH rise in sequence. The drain lines 5 are sequentially selected synchronously with the rises of the pulses. Then, the video signal voltages VD are applied to the pixel electrodes 6, the first supplementary capacities 10*a* and the second supplementary capacities 10*b* in order. The first video signal voltage VDa is applied to the pixel electrodes 6 and the first supplementary capacities 10*a*. The second video signal voltage VDb is applied to the pixel electrodes 6 and the second supplementary capacities 10*b*.

When the video signal voltages VD have been applied to all of the drain lines 5, the supply of the gate signal GV1 to the gate line 7 at the first row is terminated, and the TFTs 9 connected to the gate line 7 at the first row are turned off. Then, the pulses of the gate signal GV2 and the gate signal GV3 sequentially rise. The gate signal GV2 is applied to the gate line 7 at the second row, the gate signal GV3 is applied to the gate line 7 at the third row, and so on. The operation is then repeated.

In a period in which the TFTs 9 connected to the gate line 7 at a certain row are turned off, i.e. in a period in which the gate signal GV is not supplied to the gate line 7, the polarities of the potential SCa of the first supplementary capacity line 8*a* of the row and the potential SCb of the second supplementary capacity line 8*b* of the row are inverted. Meanwhile, the polarities of the supplementary capacity voltages VCa and VCb of the first supplementary capacity line 8*a* and the second supplementary capacity line 8*b* are preset to be opposite. The polarities of the supplementary capacity voltages VCa and VCb are set to take the same polarities as those of the video signal voltages applied to the pixels by the inversion of the levels. The polarities of the supplementary capacity voltages VCa and VCb are further set to thereafter maintain that state. Because the inversion of the levels is performed immediately after the turning off of the TFTs 9, the potential differences between source voltages $V_S$ and the opposite electrode 11 once become small by the turning off of the TFTs 9 after the first or the second video signal voltage VDa or VDb is applied to either of the supplementary capacities 10*a* and 10*b*. However, the potential differences between the source voltages $V_S$ and the opposite electrode 11 subsequently increase due to the application of the first or the second supplementary capacity voltage VCa or VCb.

After the gate signals GV has been supplied to all of the gate lines 7, a pulse of the vertical start signal STV again rises. The gate signal GV1 is supplied to the gate line 7 at the first row synchronously with the rise of the pulse. A similar operation is then repeated.

Figure 5A:
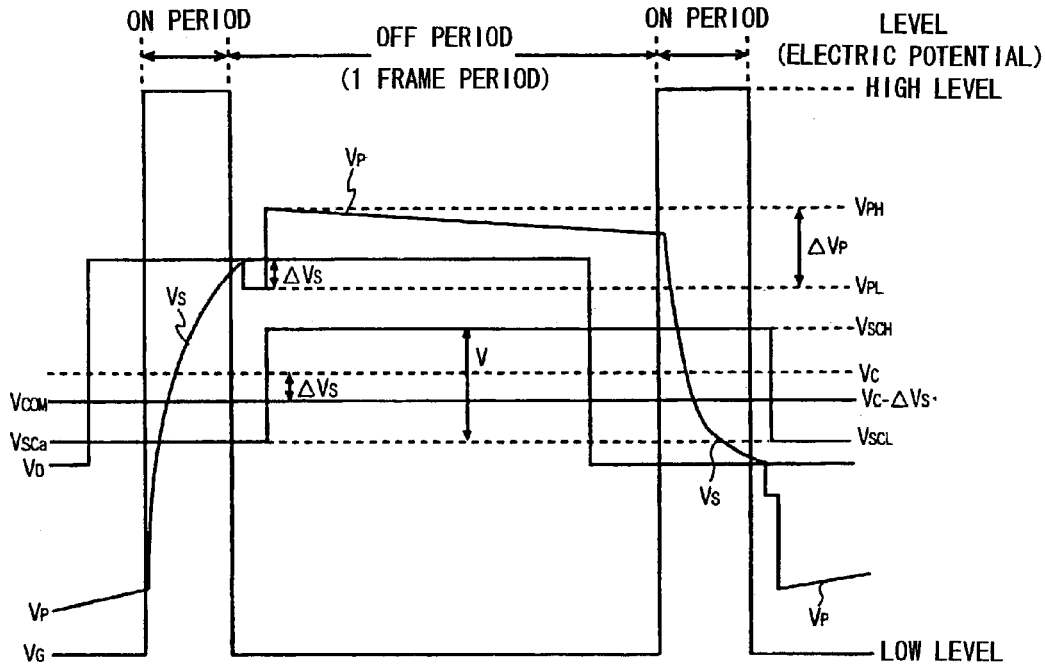
FIGS. 5*a* and 5*b* are signal waveform diagrams showing a driving method for a display according to the first embodiment of the present invention.
Figure 5B:
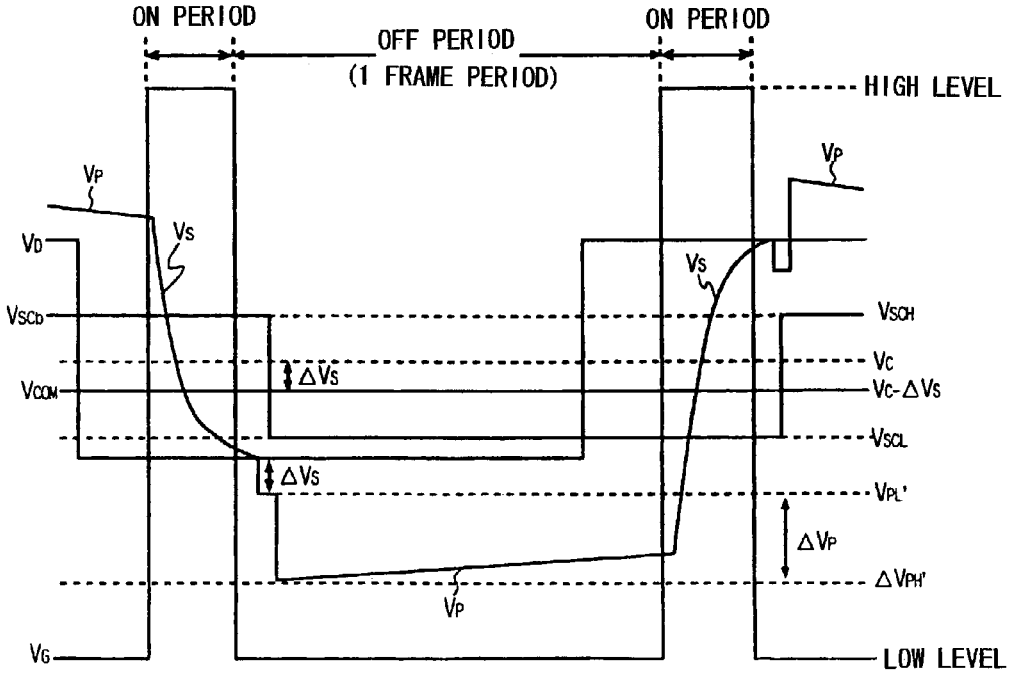
Figure 12:
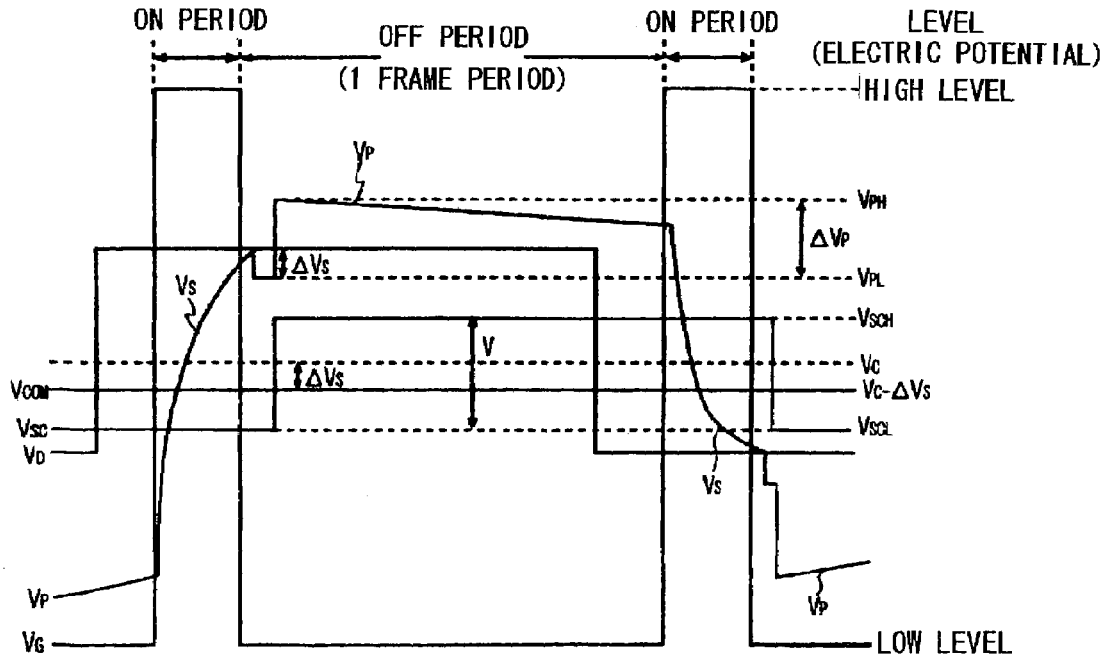
FIG. 12 is a signal waveform diagram showing a driving method of a conventional display.

FIGS. 5A and 5B are waveform diagrams showing a driving method of a display according to the first embodiment of the present invention. FIGS. 5A and 5B show waveforms for a frame in adjoining pixel regions in a gate line direction. FIG. 5A shows the signal waveforms of the first supplementary capacities 10*a*, and FIG. 5B shows the signal waveforms of the second supplementary capacities 10*b*. The waveforms shown in FIG. 5A are nearly identical to those shown in FIG. 12, but the waveforms shown in FIG. 5B are inverted in polarity from those shown in FIG. 12.

As shown in FIG. 2, the first supplementary capacities 10*a* and the second supplementary capacities 10*b* are positioned in pixels adjoining in horizontal directions. Consequently, the video signals VDa and VDb having polarities opposite to each other are applied to adjoining pixels. The supplementary capacity voltage VCa having the same polarity as that of the video signal voltage VDa is applied to the first supplementary capacities 10*a* in the pixels to which the video signal voltage VDa is applied. Moreover, the supplementary capacity voltage VCb having the same polarity as that of the video signal voltage VDb is applied to the second supplementary capacities 10*b* in the pixels to which the video signal voltage VDb is applied, and the inversion of the polarities of the supplementary capacity voltages VCa and VCb is performed during off periods of the TFTs 9. Consequently, the source voltages $V_S$ of the TFTs 9 are lowered by the voltages .$V_S$ as a result of the turning off of the TFTs 9. However, changed voltages .$V_P$ of the pixel electrodes 6, which are generated by the inversion of the supplementary capacity voltages VC, work to enlarge the voltages of the electrodes of the liquid crystal capacities 12. As a result, driving of the liquid crystal with a sufficient voltage becomes possible.

As described above, in the active matrix type display according to the present embodiment, either of the supplementary capacitors 10*a* and 10*b* is arranged in every pixel region in which a pixel electrode 6 is formed. The electrodes on one side of each of a plurality of supplementary capacities 10*a* and 10*b* aligned in row directions are connected to the sources of the TFTs 9 at respective pixels. On the other hand, the electrodes on the other sides of the supplementary capacities 10*a* arranged alternately in the row directions are linked to the first supplementary capacity lines 8*a*. Moreover, the electrodes on the other sides of the supplementary capacities 10*b* arranged alternately in the row directions are linked to the second supplementary capacity lines 8*b*.

Furthermore, the video signal voltages VD having polarities inverting every frame period are supplied to the drain lines 5. The video signal voltages VD include the first video signal voltage VDa and the second video signal voltage VDb, which are inverse to each other in their polarities. The first video signal voltage VDa and the second video signal voltage VDb are respectively applied to adjoining drain lines 5.

When the first video signal voltage VDa turns on the TFT 9 connected to the drain line 5 to which the first video signal voltage VDa is applied, the first supplementary capacity 10*a* is charged. Then, the polarity of the first supplementary capacity voltage VCa, which is applied to the first supplementary capacity line 8*a* of the pixel, is inverted to be the same as that of the first vide signal voltage VDa. Additionally, when the second video signal voltage VDb turns on the TFT 9 connected to the drain line 5 to which the second video signal voltage VDb is applied, the second supplementary capacity 10*b* in the pixel is charged. Then, the polarity of the second supplementary capacity voltage VCb, which is applied to the second supplementary capacity line 8*b* of the pixel, is inverted to be the same as that of the second vide signal voltage VDb.

As a result, so-called "dot inversion driving" can be realized through the use of the supplementary capacitor lines 8*a* and 8*b*.

In addition, in the active matrix type display, in periods of the turning on of the TFTs 9, the first video signal VDa is supplied to the first supplementary capacities 10*a* connected to the first supplementary capacity lines 8*a*, and at the same time the second video voltage VDb is supplied to the second supplementary capacities 10*b* connected to the second supplementary capacity lines 8*b*. When the TFTs 9 are turned off, the source voltages $V_S$ of the TFTs 9 are lowered as a result of the turning off of the TFTs 9. Consequently, the voltages of the supplementary capacities 10*a* and 10*b* connected to the TFTs 9 are reduced.

However, in the present embodiment, when the TFTs 9 are tuned off, the first supplementary capacity voltage VCa, the level of which was changed to the polarities of the voltages held by the first supplementary capacities 10*a* (the polarities of the source voltages $V_S$ and the pixel electrode voltages $V_P$ of the pixels at that time), is supplied to the first supplementary capacity lines 8*a*, and the second supplementary capacity voltage VCb, which has a polarity opposite that of the first supplementary capacity voltage VCa and a level changed to the polarities of the voltages held by the second supplementary capacities 10*b* (the polarities of the source voltages $V_S$ and the pixel electrode voltages $V_P$ of the pixels at that time), is supplied to the second supplementary capacity lines 8*b*. Thereby, it becomes possible to compensate for the held voltages of the first and the second supplementary capacities 10*a* and 10*b*, which have changed by the turning-off operation of the TFTs 9. Furthermore, it is also possible to increase the voltages held by the first and the second supplementary capacities 10*a* and 10*b*.

The present embodiment removes the influences of the adjoining video signal voltages by performing the dot inversion driving to prevent the generation of nonuniform images due to capacity coupling. Furthermore, the first and the second supplementary capacity voltages are applied to the first and the second supplementary capacity lines, respectively. The polarities of the first and the second supplementary capacity voltages are inverted during the periods in which the switching elements (TFTs 9) are turned off. The polarities of the first and the second supplementary capacity voltages are opposite each other. Thereby, even if the amplitudes of the video signal voltages are made to be small, it is possible to supply sufficient voltages to the liquid crystal, and thereby the electrical power consumption of the display can be reduced.

Although in the present embodiment the first and the second supplementary capacity lines 8*a* and 8*b* are alternately configured to include supplementary capacity electrodes at every pixel as a unit in the row directions for reducing variance and flicker to the extent possible, the preset invention is not limited to such a configuration. The first and second supplementary capacities 10*a* and 10*b* may be arranged at every plural column of pixels aligned in row directions, continually as a single unit.

For example, three pixels displaying primary colors of red, green and blue (RGB), respectively, may be configured as one unit, and the supplementary capacities 10*a* and 10*b* may be alternately connected to either of the first and the second supplementary capacity lines 8*a* and 8*b* at every unit of three pixels.

Next, a second preferred embodiment of the present invention will be described.

In the first embodiment, as shown in FIG. 2, the first supplementary capacity lines 8*a* and the second supplementary capacity lines 8*b* are formed to be superposed on all of the supplementary capacity electrodes 10*x*. Superposition area 13, in which the first supplementary capacitor lines 8*a* are superposed on semiconductor layers continued from the supplementary capacity electrodes 10*x*, are provide just in the pixel regions in which the second supplementary capacity lines 8*b* and the supplementary capacity electrodes 10*z* forming the second supplementary capacities 10*b* are present. A parasitic capacitance $C_{PAR}$ is generated at the superposition area 13.

Figure 6:
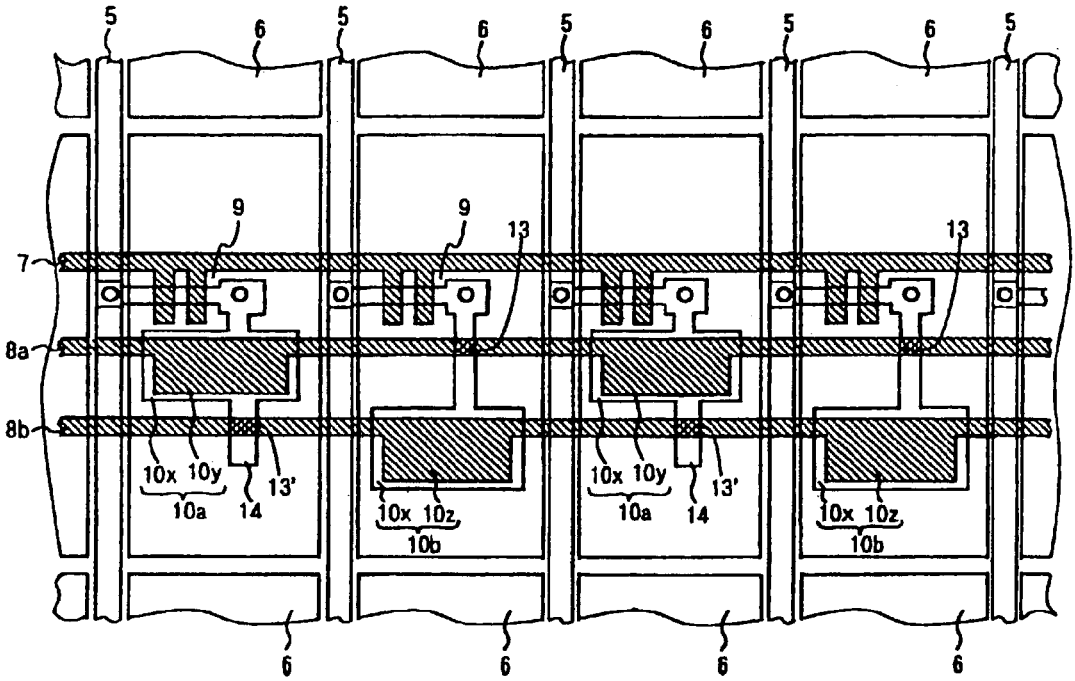
FIG. 6 is a plan view of a display panel according to a second embodiment of the present invention.
Figure 7:
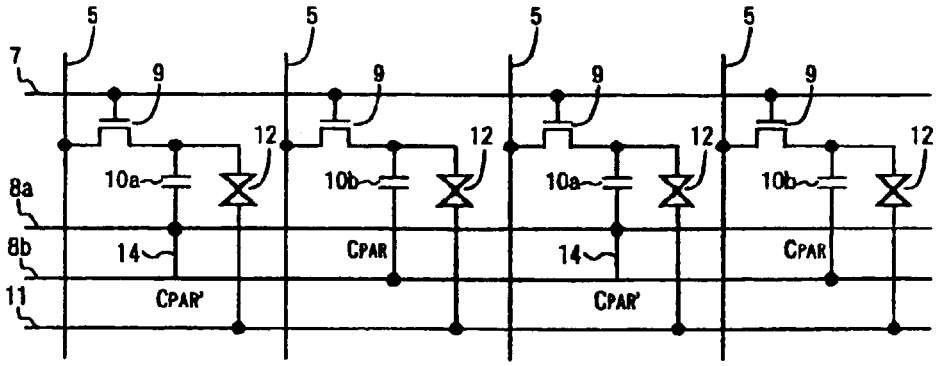
FIG. 7 is an equivalent circuit diagram of the display panel according to the second embodiment of the present invention.

The configuration of the second embodiment solves the problems that result when the parasitic capacitance $C_{PAR}$ is formed only for the second supplementary capacities 10*b*. FIG. 6 is a plan view of a display panel according to the second embodiment. FIG. 7 is an equivalent circuit diagram of the display panel. The same components as those of the first embodiment are designated by the same reference numerals as those of the first embodiment, and the descriptions related to the components will not be repeated.

The present embodiment differs from the first embodiment in that the embodiment is provided with sections of dummy wiring 14, which are formed elongated from the supplementary capacity electrodes 10*x* and superposed on the second supplementary capacity lines 8*b*. This dummy wiring 14 forms superposition area 13' on the second supplementary capacity lines 8*b*, which does not form any supplementary capacity in the pixel regions. Thereby, the second embodiment forms parasitic capacitance $C_{PAR'}$ equal to the parasitic capacitance $C_{PAR}$ at the superposition area 13 of the supplementary capacity electrodes 10*x* on the first supplementary capacity lines 8*a*.

In the first embodiment, because the parasitic capacitance $C_{PAR}$ is generated only at the superposition area 13 of the supplementary capacity electrodes 10*x* on the first supplementary capacity lines 8*a*, only the electric potential of the second supplementary capacities 10*b* including the supplementary capacity electrodes 10*z* is lowered. Consequently, the magnitude of the optimum opposite electrode voltages to the pixel electrodes 6 din the pixel regions in which the supplementary capacity electrodes 10*y* are present differs from that in the pixel regions in which the supplementary capacity electrodes 10*z* is present. This difference of the magnitudes of the optimum opposite electrode voltages enables simple dispersion of contrast and flicker.

However, in the present embodiment, the dummy wiring 14 is formed to the first supplementary capacity electrodes 10*x*. Thereby, the superposition area 13' are formed at the places where the dummy wiring 14 are superposed on the second supplementary capacitance lines 8*b*, which do not form any supplementary capacity with the first supplementary electrode 10*x*. Then, the parasitic capacitance $C_{PAR'}$ is generated at the superposition area 13'.

As a result, the polarities of the first supplementary capacitors 10*a* and the second supplementary capacitors 10*b* are balanced. Thereby, it becomes possible to prevent the generation of differences of the magnitudes of the optimum opposite electrode voltages to the respective pixel electrodes 6. Consequently, the dispersion of contrast or flicker caused by the differences can be accomplished.

Figure 8:
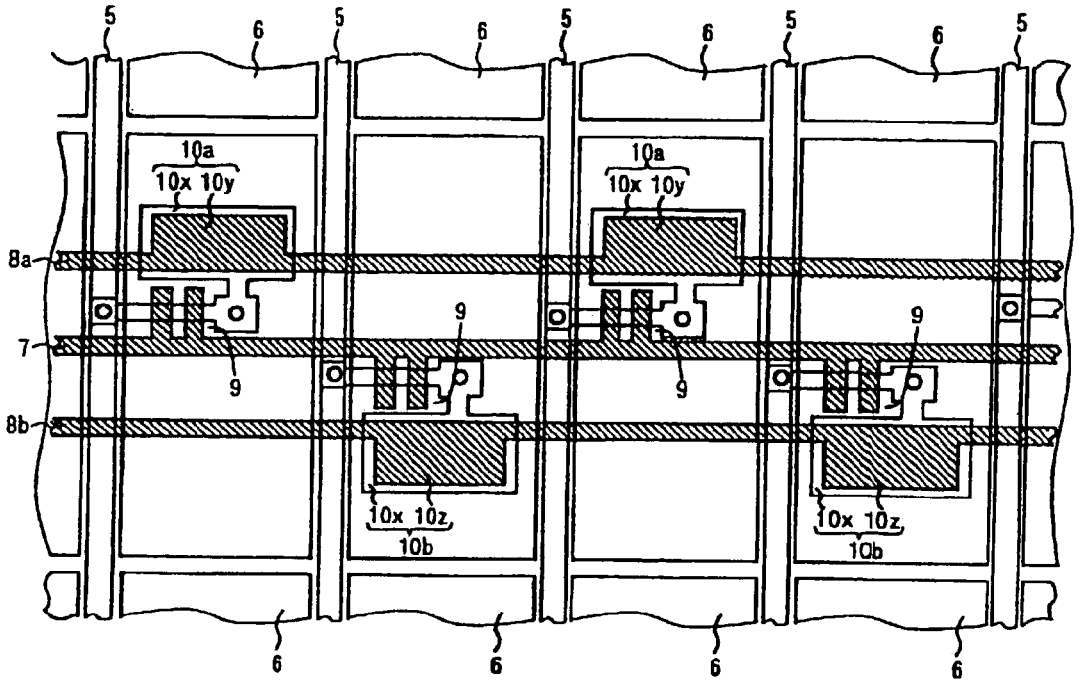
FIG. 8 is a plan view of a display panel according to a third embodiment of the present invention.
Figure 9:
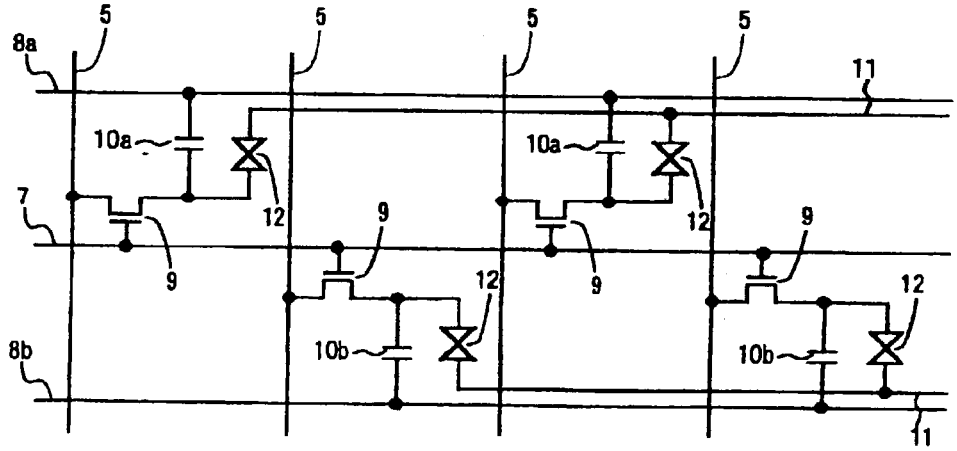
FIG. 9 is an equivalent circuit diagram of the display panel according to the third embodiment of the present invention.

Next, a third preferred embodiment of the present invention will be described. FIG. 8 is a plan view of a display panel according to the third embodiment. FIG. 9 is an equivalent circuit diagram of the display panel. The same components as those of the first embodiment are designated by the same reference numerals as those of the first embodiment, and the descriptions related to the components will not be repeated. In the present embodiment, the arrangement of the drain lines 5 and the pixel electrodes 6 is the same as in the first and the second embodiments.

The present embodiment differs from the first and the second embodiments in that the gate lines 7 are arranged between the first supplementary capacity lines 8*a* and the second supplementary capacity lines 8*b* at the central parts of the pixel electrodes. Moreover, the gate electrodes are formed in the regions in which the supplementary capacity electrodes 10*x* are arranged from the gate lines 7 as boundary lines. The gate electrodes are integrally formed with the gate lines 7 in each pixel region, and constitute the TFTs 9.

In the second embodiment, because the dummy wiring is formed in addition to the essentially necessary supplementary capacity electrodes, the pattern of the electrodes becomes complicated or the aperture ratio of the display panel is reduced.

However, in the present embodiment, because the gate lines 7 are arranged between the first supplementary capacity lines 8*a* and the second supplementary capacity lines 8*b*, all of the supplementary capacity electrodes 10*x* are superposed only on one of the first supplementary capacity lines 8*a* or the second supplementary capacity lines 8*b*, which constitute the supplementary capacities 10*a* and 10*b* with the supplementary capacity electrodes 10*x*, respectively. Consequently, because the superposition area 13 and 13' themselves are not created, no resulting and parasitic capacitance $C_{PAR}$ is generated.

Moreover, in the present embodiment, the distances from the second supplementary capacity lines 8*b* to the TFTs 9 can be shortened to reduce the wiring resistance of the second supplementary capacity lines 8*b*. Because the areas of the semiconductor layers for forming the supplementary capacitance electrodes 10*x* in the first embodiment and the dummy wiring 14 in the second embodiment can be reduced, the aperture ratio of the display panel is in turn improved.

Although double gate type TFTs are exemplified in the above embodiments, the present invention is not limited to this type of the TFT. The number of gate electrodes may be one, three, or more. Moreover, although in the above descriptions, the supplementary capacity lines are formed in the same layer as that of the gate lines, the supplementary capacity lines may be formed in a different layer.

Furthermore, although active matrix type liquid crystal displays are exemplified above, the present invention is not limited to active matrix displays. The present invention can, for example, also be applied to an active matrix type electroluminescence (EL) display.

As described above, the present embodiment includes a plurality of first and the second supplementary capacity lines extending in row directions correspondingly to each row of pixel electrodes. In addition, the supplementary capacities are arranged alternately at every row of the pixel electrodes correspondingly to the first and the second supplementary capacity lines. Thereby, it is possible to supply signals having different polarities to each supplementary capacity line. Consequently, it becomes possible to realize dot inversion driving, in which voltages having different polarities are applied to every adjoining pixels through the first and the second supplementary capacity lines.

Moreover, it may be preferable to perform display by applying either of the first video signal voltage having a polarity inverted at every frame and the second video signal voltage having a polarity inverse to that of the first video signal voltage to the pixel electrodes. It may also be preferable to supply the first and the second supplementary capacity lines with first and the second supplementary capacity voltages having opposite phases which change during off periods of the switching elements. In particular, the polarities of the first video signal voltage and the first supplementary capacity voltage are made to be same, and the polarities of the second video signal voltage and the second supplementary capacity voltage are made to be same. Thereby, the dot inversion driving using the supplementary capacity lines are realized, and the amplitudes of video signal voltages can be made small.

Furthermore, it is preferable that the first and the second supplementary capacity lines include the supplementary capacity electrodes alternately at every plural number of columns of continually arranged pixel electrodes. For example, the pixel electrodes which display the three primary colors RGB may be formed as a group, in which case it becomes possible to apply voltages having polarities inverse to each other to every adjoining group. Thereby, inversion driving of every group unit can be realized.

Furthermore, it is preferable that the first and the second supplementary capacity lines are respectively superposed on all of the supplementary electrodes arranged correspondingly to each row of the pixel electrodes, on which the first and the second supplementary capacity lines are formed. Thereby, the polarities of the parasitic capacitance generated at the superposition regions, where the supplementary capacity lines which do not form any supplementary capacity are superposed on the supplementary capacity electrodes, can be balanced. Consequently, uniformity of images can be assured.

Moreover, it is preferable that the supplementary capacity electrodes include dummy wiring superposed on the supplementary capacity lines which do not form any supplementary capacities in the pixel regions of the first and the second supplementary capacity lines. Consequently, the first and the second supplementary capacity lines are superposed on all of the supplementary electrodes. The polarities of the parasitic capacitance generated in the regions where the supplementary capacity lines which do not form any supplementary capacities in the regions are superposed on the supplementary electrodes can be balanced. Consequently, the uniformity of images can be assured.

Moreover, it may be preferable for the gate lines to be arranged between the first and the second supplementary capacity lines in the pixel regions where the pixel electrodes are formed. Thereby, it becomes possible to remove the regions where the supplementary capacity lines which do not form any supplementary capacities are superposed on the supplementary capacity electrodes and the parasitic capacitance to be generated at the regions. Consequently, the uniformity of images can be assured.

It is preferable that the gate lines include the gate electrodes, which constitute the switching elements and are formed in the regions where the supplementary capacity electrodes are arranged from the gate lines as boundary lines in the pixel regions. Thereby, it becomes possible to remove the regions where the supplementary capacity lines which do not form any supplementary capacities are superposed on the supplementary capacity electrodes and the parasitic capacitance to be generated in the regions. Consequently, the uniformity of images can be assured.

Furthermore, in the active matrix type display, because a common electrode (opposite electrode 11) is arranged on the second substrate, and a fixed voltage is applied to the common electrode, no voltage variations of the common electrode, which has a large area, are generated, and consequently the active matrix type display can be driven by lower voltages consuming less electrical power.

Moreover, during the off periods of the switching elements (TFTs 9), the levels of the first and the second supplementary capacity voltages are inverted immediately after the turning off of the switching elements. Consequently, the turning-off operations of the switching elements do not easily influence the display, and it is possible to compensate for variation in charge of the supplementary capacities during the period in which the variations of the voltages held by the first and the second supplementary capacities are small. Consequently, an increased amount of charge can be used for increasing the voltages held by the first and the second supplementary capacities.

As described above, according to the present embodiment, an active matrix type display having a high display quality can be provided.

Figure 10A:
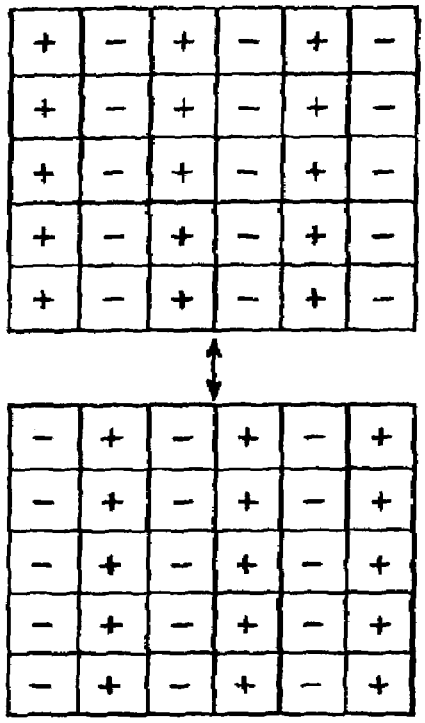
FIGS. 10*a* and 10*b* are conceptual diagrams showing vertical inversion driving and dot inversion driving.

Voltages having the same polarities can also be applied to pixel electrodes adjoining in the drain lines. In this case, the vertical inversion driving as shown in FIG. 10A is preferably performed.

Figure 10B:
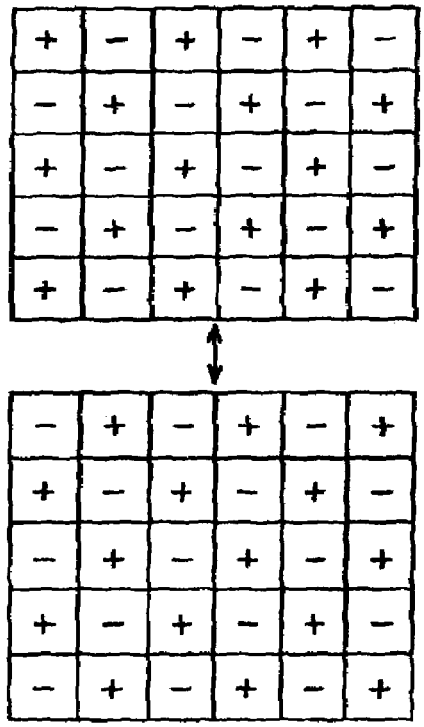
Figure 11:
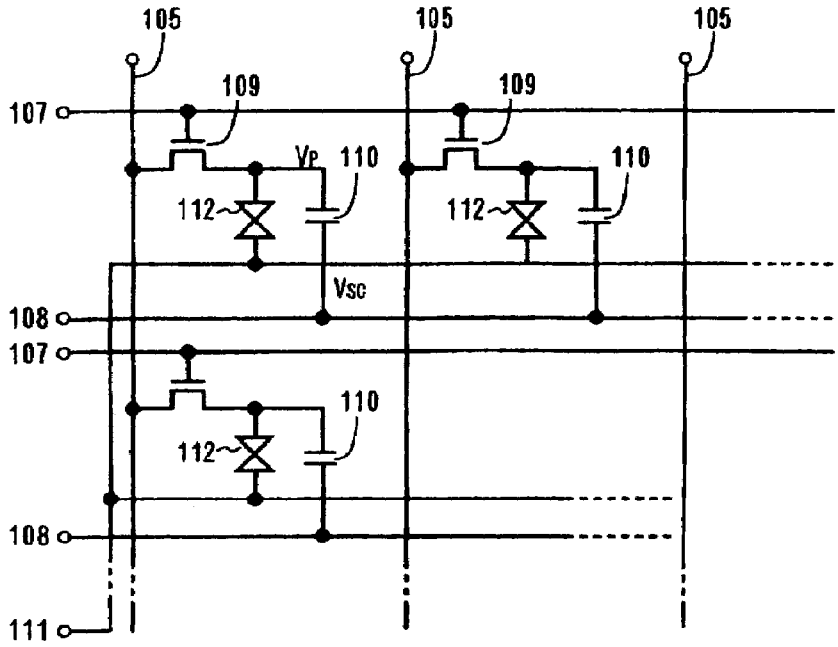
FIG. 11 is an equipment circuit diagram showing a conventional display panel.

However, in consideration of characteristics, it is preferable to perform the dot inversion driving, in which inverted polarity voltages are applied to all of the pixels adjoining above and below and right and left as shown in FIG. 10B. As shown in FIGS. 10A and 10B, voltages having the polarities inverse to those of the preceding frame are applied at every frame in both of the driving systems.

By performing the dot inversion driving, it is possible to prevent the deterioration of liquid crystal, and it is also possible to effectively prevent capacity coupling.

What is claimed is:

1. An active matrix type display including a plurality of pixels arranged in a matrix, said display controlling display of said pixels at every pixel, said display comprising:

a plurality of gate lines extending in row directions, said gate lines transmitting gate voltages;

a plurality of data lines extending in column directions, said data lines transmitting video voltages;

switching elements arranged correspondingly to intersection points of said gate lines and said data lines;

pixel electrodes connected to said data lines through said switching elements;

a plurality of first and second supplementary capacity lines extending in the row directions correspondingly to each line of said pixel electrodes; and a supplementary capacity electrode arranged to be superposed on any one of said first and said second supplementary capacity lines at each pixel.

2. The display according to claim 1, wherein said first and said second supplementary capacity lines receive a first and a second supplementary capacity voltages opposite in phase to each other, said voltages changing during off periods of said switching elements.

3. The display according to claim 1, wherein a fixed voltage is applied to an opposite electrode formed on an opposite substrate opposed to a substrate including said pixel electrodes formed thereon, and said first and said second supplementary capacity lines receive a first and a second supplementary capacity voltages opposite in phase to each other, said voltages changing during off periods of said switching elements.

4. The display according to claim 1, wherein said supplementary capacity electrode at each pixel is alternately superposed on any one of said first and said second supplementary capacity lines for every row of said pixels as a unit.

5. The display according to claim 1, wherein said supplementary capacity electrode of each pixel is alternately superposed on any one of said first and said second supplementary capacity lines for every predetermined plural number of continuous rows of said pixels as a unit.

6. The display according to claim 1, wherein said first and said second supplementary capacity lines are superposed on all of said supplementary capacity electrodes arranged correspondingly to each row of said pixels at which said first and said second supplementary capacity lines are formed.

7. The display according to claim 6, wherein said supplementary capacity electrodes form supplementary capacities with one group of said first and said second supplementary capacity lines, and said supplementary capacity electrodes include dummy wiring superposed on the other group of said first and said second supplementary capacity lines, which do not form said supplementary capacities.

8. The display according to claim 1, wherein said gate lines are arranged between said first and said second supplementary capacity lines in pixel regions in which said pixel electrodes are formed.

9. The display according to claim 8, wherein said gate lines includes gate electrodes constituting said switching elements, said gate electrodes formed from said gate lines as boundary lines in regions in which said supplementary capacity electrodes are arranged.

10. An active matrix type display including a plurality of pixels arranged in a matrix, said display controlling display of said pixels by every pixel, said display comprising:

a plurality of pixel electrodes arranged in a matrix on a first substrate;

switching elements severally connected to said pixel electrodes;

first or second supplementary capacity electrode arranged severally at every pixel region in which said pixel electrodes are arranged;

a first and a second supplementary capacity lines arranged correspondingly to each row of said pixel electrodes; and a first and a second supplementary capacities composed of any one of said first and said second supplementary capacity lines and said first and said second supplementary capacity electrodes superposed on said one of said first and said second supplementary capacity lines, wherein said display performs display by applying either of a first video signal voltage having a polarity inverting at every frame period and a second video signal voltage having a polarity inverse to said polarity of said first video signal voltage to said pixel electrodes and said first and said second supplementary capacity electrodes, and said display supplies a first and a second supplementary capacity voltages to said first and said second supplementary capacity lines, said supplementary capacity voltages changing in level during periods in which said switching elements are turned off.

11. The display according to claim 10, wherein said display supplies said first video signal voltage to said first supplementary capacity electrodes and said display supplies said second video signal voltage to said second supplementary capacity electrodes during periods in which said switching elements are turned on, and a level of said first supplementary capacity voltage supplied to said first supplementary capacity lines changes to have a polarity same as that of said first video signal voltage, and a level of said second supplementary capacity voltage supplied to said second supplementary capacity lines changes to the same polarity as that of said second video signal voltage during periods in which said switching elements are turned off.

12. The display according to claim 10, wherein said display supplies said first video signal voltage to said first supplementary capacity electrodes, said display supplies said first supplementary capacity voltage having a polarity inverse to that of said video signal voltage to said first supplementary capacity lines, said display supplies said second video signal voltage to said second supplementary capacity electrodes, and said display supplies said second supplementary capacity voltage having a polarity inverse to that of said second video signal voltage to said second supplementary capacity lines during periods in which said switching elements are turned on, and a level of said first supplementary capacity voltage changes to the same polarity as said first video signal voltage, and a level of said second supplementary capacity voltage changes to the polarity of said second video signal voltage during periods in which said switching elements are turned off.

13. The display according to claim 10, said display further comprising a common electrode arranged on a second substrate, wherein a fixed voltage is applied to said common electrode.

14. The display according to claim 10, wherein levels of said first and said second supplementary capacity voltages are changed immediately after said switching elements are turned off during periods in which said switching elements are off.

* * * * *